US006253428B1

(12) United States Patent
Wang

(10) Patent No.: US 6,253,428 B1
(45) Date of Patent: Jul. 3, 2001

(54) BUCKLE SET ON A CLOTH STRIP FOR A BRASSIERE

(76) Inventor: Kuo-Tso Wang, No. 11, Lane 72, Tian-Hsiang Street, Hsin-Chung, Taipei (TW)

( * ) Notice: Subject to any disclaimer, the term of this patent is extended or adjusted under 35 U.S.C. 154(b) by 0 days.

(21) Appl. No.: 09/436,499

(22) Filed: Nov. 9, 1999

(51) Int. Cl.[7] ..... A44B 11/00; A44B 13/00

(52) U.S. Cl. ..... 24/701; 24/695

(58) Field of Search ..... 24/701, 702, 614, 24/532, 615, 695, 662, 114.4, 187, 326, 68 E, 585; 2/73, 322, 323; 450/1, 47, 45, 28, 58, 86

(56) References Cited

U.S. PATENT DOCUMENTS

| | | | | |
|---|---|---|---|---|
| 736,811 | * | 8/1903 | Booth | 24/695 |
| 1,166,417 | * | 12/1915 | Snyder | 24/695 |
| 1,202,372 | * | 10/1916 | Foner | 24/695 X |
| 2,446,018 | * | 7/1948 | Miskimen | 24/701 X |
| 4,054,972 | * | 10/1977 | Rowell | 24/702 X |
| 4,993,127 | * | 2/1991 | Mechen et al. | 24/701 |
| 5,485,658 | * | 1/1996 | Fildan | 24/614 |

* cited by examiner

*Primary Examiner*—Robert J. Sandy
(74) *Attorney, Agent, or Firm*—Jacobson Holman PLLC

(57) ABSTRACT

A buckle set on a cloth strip for a brassiere includes a male buckle and a female buckle. By the cloth strip, the buckle set can be directly stitched to the belts at two sides of the two cups of a brassiere. The male buckle has a round disk shape and has a pillar installed thereon. The lower end of the pillar has a lip portion. The female buckle has an oblong disk shape and a buckle hole in the middle part thereof. By the pillar of the male buckle pressing into and buckling with the buckle hole of the female buckle, the two belts are connected. The buckle hole on the female buckle has a long shape, The long axis of the buckle hole includes a flange at an inner periphery at one end so that one end of the buckle hole includes a guide groove. Thus, the pillar of the male buckle buckles with the buckle hole at the larger opening and then is pushed into the guide groove. Thus, the male buckle can be firmly fastened to the female buckle. Besides, the length of the pillar of the male buckle is equal to the thickness of the female buckle. Thus, the two buckles can be combined together for preventing release. Moreover, the thickness can be reduced in order to avoid an uncomfortable sense and to effect a beautiful look.

1 Claim, 4 Drawing Sheets

BUCKLE SET ON A CLOTH STRIP FOR A BRASSIERE

FIELD OF THE INVENTION

The present invention relates to a buckle set on a cloth strip for a brassiere comprising a male buckle and a female buckle. The female buckle has a guide groove and a buckle hole. Thus, the two buckles can be combined together for preventing release. Moreover, the thickness can be reduced in order to avoid an uncomfortable sense and to effect a beautiful look.

BACKGROUND OF THE INVENTION

In general, brassieres' metal hooks are seamed on the belts at two sides of the cups. By the metal hooks, the two belts can be connected together. Thus, the brassiere can be worn on a woman. However, in washing, by hand, the metal hooks are possibly hooked on the user's hand. In general, the metal hook is made of iron material and then is processed by plating. The plated layer easily is removed due to washing. Once the plating layer is removed, the iron metal will generate rust so as to stain the clothes. Moreover, plating will generate a large amount of industrial waste water. Recently, the sense of environment pollution is more and more of a concern such kind of buckle is not acceptable.

Therefore, current brassieres employ buckles made of plastic material, as shown in FIG. 4. In this kind of buckle, the buckle sets are connected to the left and right belts of the cups of the brassiere. The distal end thereof has a hook a1 and a plate a2 which are integrally formed and then are clamped to a belt b. Thus, the hook and plate have a large volume, i.e. a large thickness. From the figure, it is shown that if a force is applied, the buckle sets a will be tightly buckled. However, the force is very possible to generate twisting force so that the hooks are possibly released. The reason of the twisting force is that if a force is applied, one side of the buckle a will be twisted so that the hook is possibly released. Therefore, such a structure is not an ideal structure.

Besides, as shown in FIG. 5, the buckle set is formed by a male buckle c and a female buckle d. The male buckle c has a protrusion c1, and the edge of the protrusion c1 is installed with a lip portion c11. An oblong joint hole d1 is installed in the female buckle d. The protrusion c1 of the female buckle c can be pressed into the joint hole d1 of the male buckle d. Since the joint hole d1 of the female buckle d has an oblong shape, even the positioning of the male buckle c and the female buckle d are not accurate. The protrusion c1 of the male buckle c can still be easily pressed into the joint hole d1 of the female buckle d so that the male buckle c may press into the female buckle d. Such kind of buckling may be embodied in various objects. If it is embodied in a brassiere, the lip portion c11 atop the protrusion c1 of the male buckle c projects through the joint hole d1 of the female buckle so that it can be connected to the two belts at the rear side of the brassiere. But the lip portion c1 on the male buckle c projects through the joint hole d1 of the female buckle d by the elasticity of the material of the lip portion itself. If the lateral force is too large, the male buckle c and female buckle d are easily released. Therefore, this design is not ideal.

Thus, as described above, in one prior art embodiment, the metal hook is connected to the belt of a brassiere, and in washing, the plated layer easily falls off due to washing. Once the plating layer is removed, the iron metal will rust so as to stain the clothes. The structure shown in FIG. 4, has a large volume, i.e. a large thickness. If a force is applied, the buckle sets a will tightly buckle. However, the force is very possible to generate twisting force so that the hooks are possibly released. For the structure shown in FIG. 5, the lip portion c1 on the male buckle c projects through the joint hole d1 of the female buckle d by the elasticity of the material of the lip portion itself. If the lateral force is too large, the male buckle c and female buckle d are easily released. Thus, the abovesaid prior art structures not ideal designs.

SUMMARY OF THE INVENTION

Accordingly, the primary object of the present invention is to provide a buckle set of a cloth strip for a brassiere comprising a male buckle and female buckle on a cloth strip. On the cloth strip, the buckle set can be directly seamed to the belts at two sides of the two cups of a brassiere. The male buckle is a round disk shape and has a pillar installed thereon. The lower end of the pillar has a lip portion. The female buckle has an oblong disk shape and a buckle hole is installed in the middle part thereof. By the pillar of the male buckle to press into and buckle with the buckle hole of the female buckle, the two belts are connected. The buckle hole on the female buckle has a long shape. The long axis of the buckle hole is installed with a flange at an inner periphery at one end so that one end of the buckle hole is installed with a guide groove. Thus, the pillar of the male buckle buckles with the buckle hole at the larger opening and then is pushed into the guide groove. Thus, the male buckle can be firmly fastened to the female buckle. Besides, the length of the pillar of the male buckle is equal to the thickness of the female buckle. Thus, the two buckles can be combined together for preventing release. Moreover, the thickness can be reduced in order to avoid an uncomfortable sense and to effect a beautiful look.

The various objects and advantages of the present invention will be readily understood from the following detailed description when read in conjunction with the appended drawing.

DETAILED DESCRIPTION OF THE PREFERRED EMBODIMENTS

Figure 1:
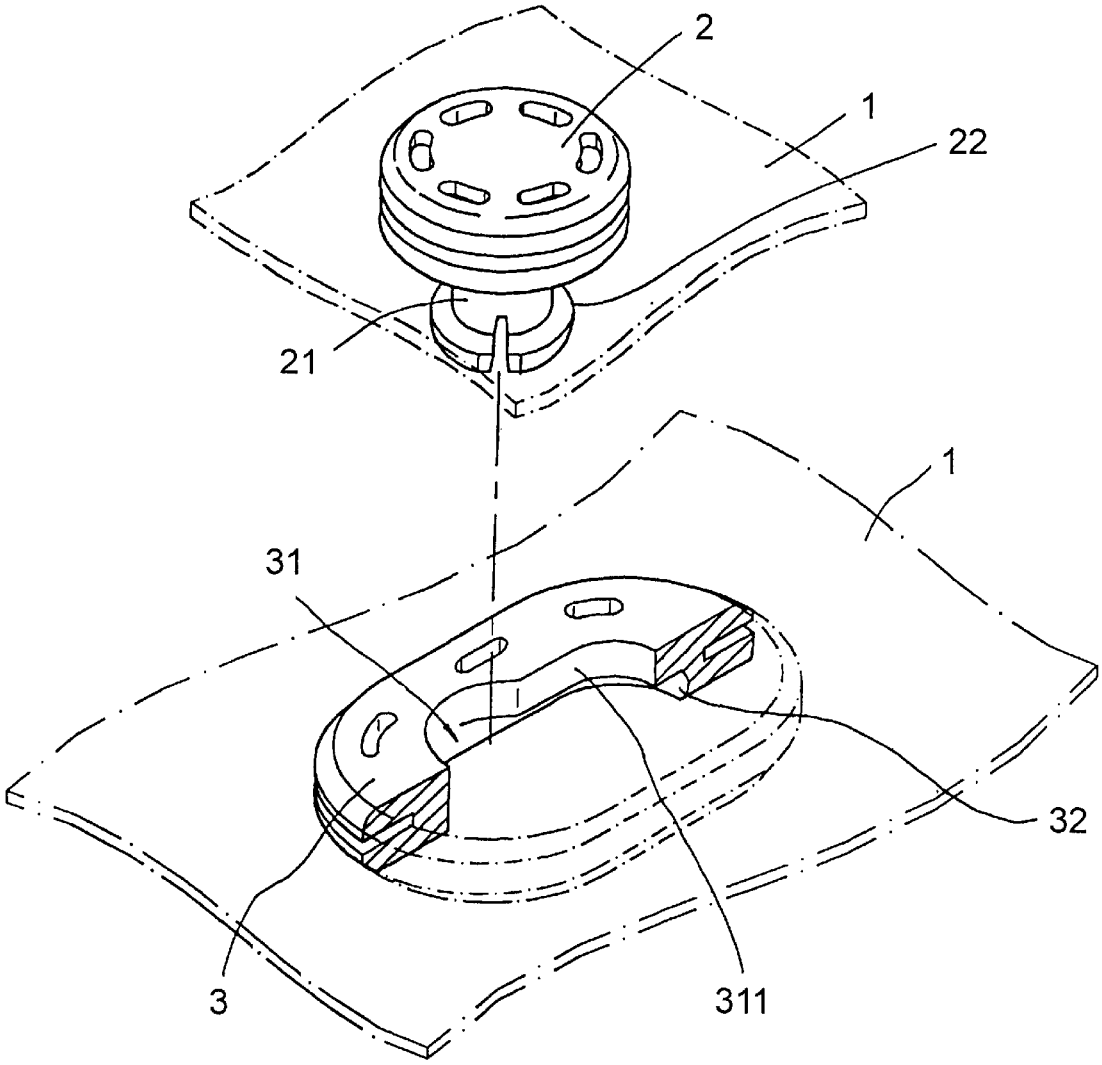
FIG. 1 is a perspective view of the present invention.
Figure 2:
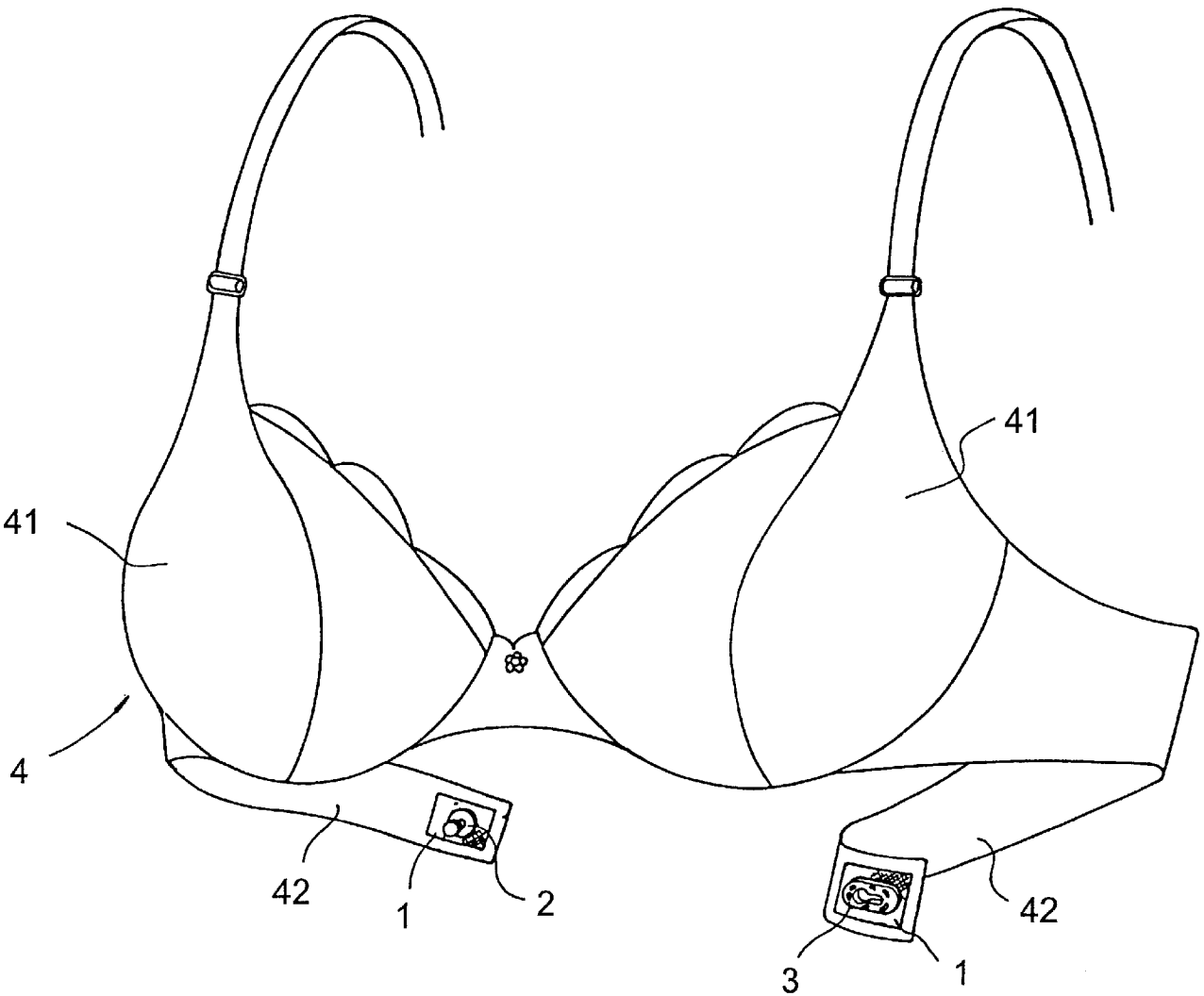
FIG. 2 is a perspective view showing the present invention being embodied to a brassiere.

With reference to FIGS. 1 and 2, the present invention is formed by a male buckle 2 and a female buckle 3 on a cloth strip 1. By the cloth strip 1, the present invention can be directly stitched to the belts 42 at two sides of the two cups 41 of a brassiere 4 as best shown in FIG. 2. The male buckle 2 is a round disk shape and has a pillar installed thereon, The upper end of the pillar 21 has a lip portion 22. The female buckle 3 has an oblong disk shape and a buckle hole 31 installed in the middle part thereof. By the pillar 21 of the male buckle 2 to press into and buckle with the buckle hole 31 of the female buckle 3, the two belts 42 are connected.

Figure 3:
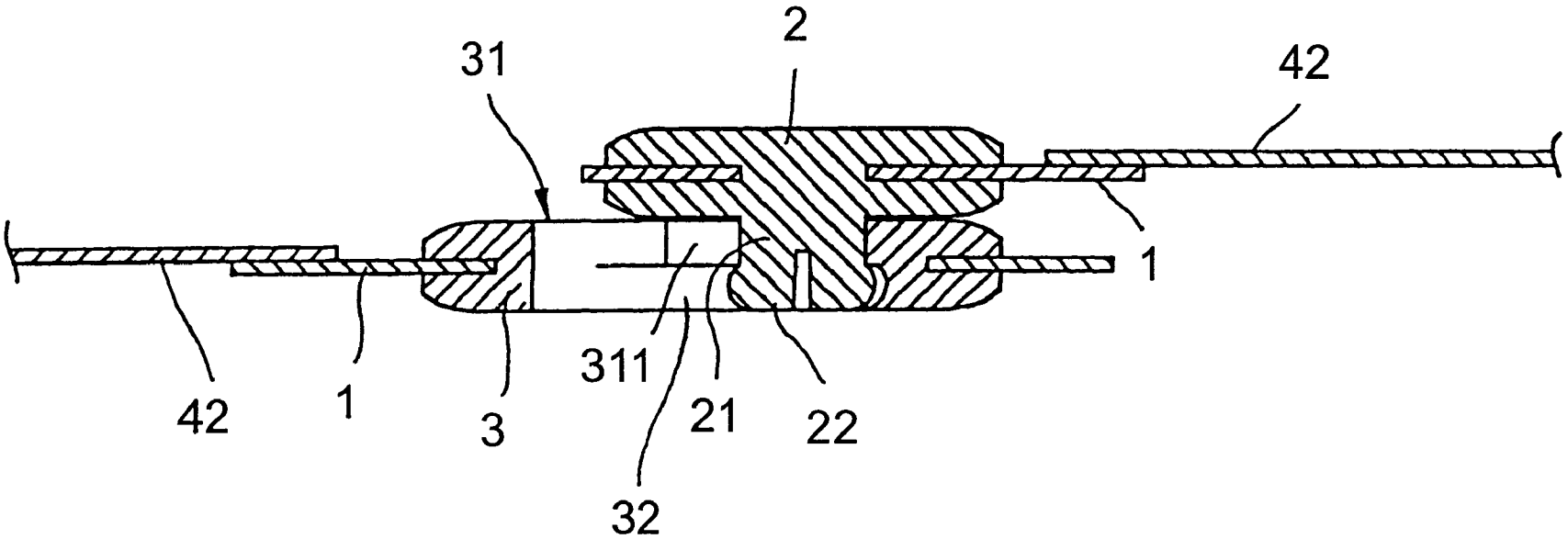
FIG. 3 is a cross sectional view of the present invention.
Figure 4:
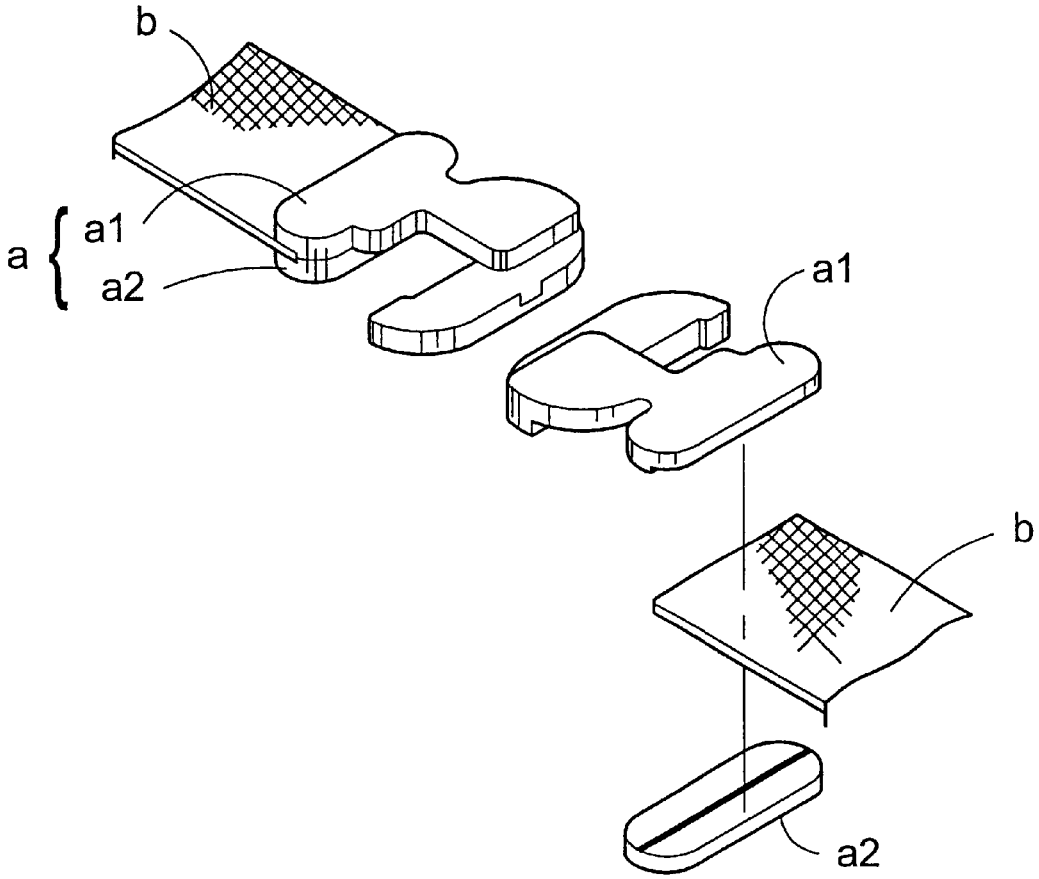
FIG. 4 (PRIOR ART)
FIG. 4 is a perspective view of a prior art design.
Figure 5:
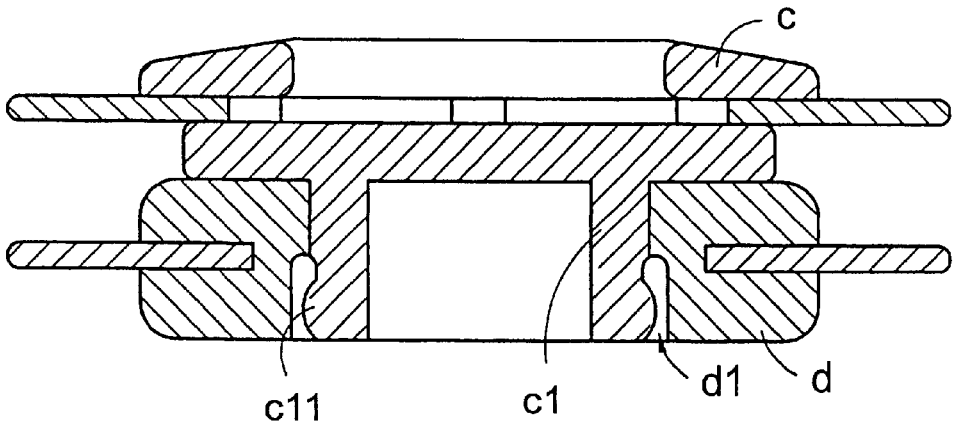
FIG. 5 (PRIOR ART)
FIG. 5 is an assembled cross sectional view of another prior art design.

The buckle hole 31 on the female buckle 3 has a long shape. One end of the long axis of the buckle hole 31 includes with a flange 311 at an inner periphery so that one end of the buckle hole 31 includes as undercut portion forming a guide groove 32. Thus, the pillar 21 of the male buckle 2 may buckle with the buckle hole 31 at the larger opening and then is pushed into the flange 311. Thus, the male buckle 2 can be firmly fastened to the female buckle 3. The length of the pillar 21 of the male buckle 2 is equal to the thickness of the female buckle 3, as shown in FIG. 3.

According to the aforesaid structure, when the male buckle 2 presses into the buckle hole 31 of the female buckle 3, the lip portion 2 of the male buckle 22 can be inserted into the buckle hole 31 and then is pushed toward the guide groove 32 so that the pillar 21 of the male buckle 2 slides into the guide groove 32. Moreover, since the lower end of the pillar 21 in the male buckle 2 has a lip portion 22, and the buckle hole 31 of the female buckle 3 has a flange 311, when the pillar 21 is pushed toward the guide groove 32, the lip portion 22 at the lower end of the pillar 21 will be positioned against the lower end of the flange 311 of the guide groove 32 so that the lip portion 22 on the male buckle 2 may be embedded into the guide groove 32 of the female buckle 3 so as to be engaged tightly. Therefore, as the pull force is increased, the male buckle 2 and female buckle 3 are prevented from being released.

The male buckle 2 is engaged on the lower side of the flange 311 of the female buckle 3 by the lip portion 22. If a lateral force is applied so that a twisted force is generated, the male buckle 2 and female buckle 3 will not be released due to the twisted force.

Moreover, the male buckle 2 and female buckle 3 are integrally formed on the cloth strips 1, respectively. The cloth strip 1 can be formed with male buckle 2 or female buckle 3 continuously with proper spaces. Thus, in use, the male buckle 2 or female buckle 3 can be secured by stitching to the respective positions on the belts 42 of brassieres by the cloth strip 1, and then the cloth strip 1 is cut, or the cloth strip 1 is firstly cut into pieces of equal size and then secured by stitching to the belt 42. The cloth strip can be rapidly stitched during manufacturing. Furthermore, since the male buckle 2 and the female buckle 3 are integrally formed to the cloth strip 1, respectively, they have a smaller volume. That is, after assembling, the assembling body is thinner. Therefore, no uncomfortable feeling is sensed during wearing after worn. Therefore, the beautiful look of the brassiere is not affected.

Since the male buckle 2 and female buckle 3 have an approximately round shape or oblong shape without any hook, in washing, they will not hook other clothes so as not to be destroyed. Furthermore, the male buckle 2 and female buckle 3 are made of plastic. After washing, no oxidization will be generated. The prior art metal buckles are possibly oxidized and generate rust.

Besides, the male buckle 2 and female buckle 3 of the present invention can be embodied on a skirt or trousers. Similarly, the aforesaid effect can be achieved.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A buckle set for a brassiere comprising a male buckle and female buckle for mounting on separate cloth strips so as to be stitched to belts at two sides of two cups of a brassiere, the male buckle including a round disk portion having a pillar extending therefrom, a lower end of the pillar having a radially outwardly extending lip portion, the female buckle having an oblong disk shape and an elongated buckle hole located in a middle part thereof so that the pillar of the male buckle is pressed into and buckles with the buckle hole of the female buckle for connection of the two belts, the elongated buckle hole on the female buckle having a longitudinal axis with a buckle opening portion at one end of the elongated buckle hole for receipt of the lip portion and pillar of the male buckle and a reduced width opening portion, as compared to a width of the buckle opening portion, with a guide groove located below said reduced width opening portion, at an opposite end of the elongated buckle hole to engage and retain the pillar of the male buckle in the reduced width opening portion while retaining the radially outwardly extending lip portion of the male buckle in the guide groove so that the male buckle can be firmly fastened to the female buckle by first inserting the pillar and the lip portion of the male buckle into the buckle opening portion of the elongated buckle hole and then laterally sliding the pillar and the lip portion of the male buckle along the longitudinal axis into engagement with the reduced width opening portion and the guide groove, respectively, of the female buckle at the opposite end of the elongated buckle hole, and a combined length of the pillar and lip portion of the male buckle is equal to a thickness of the female buckle.

* * * * *